US008340564B2

(12) United States Patent
Kondo et al.

(10) Patent No.: US 8,340,564 B2
(45) Date of Patent: Dec. 25, 2012

(54) SHEET THICKNESS DETECTOR AND IMAGE FORMING APPARATUS USING SAME

(75) Inventors: Kazuyoshi Kondo, Toyonaka (JP); Hiroshi Fujiwara, Ikeda (JP); Toshikane Nishii, Ikeda (JP); Mizuna Tanaka, Ikeda (JP); Tomoyoshi Yamazaki, Minoo (JP); Haruyuki Honda, Minoo (JP)

(73) Assignee: Ricoh Company, Ltd., Tokyo (JP)

( * ) Notice: Subject to any disclaimer, the term of this patent is extended or adjusted under 35 U.S.C. 154(b) by 205 days.

(21) Appl. No.: 12/805,527

(22) Filed: Aug. 4, 2010

(65) Prior Publication Data

US 2011/0058829 A1 Mar. 10, 2011

(30) Foreign Application Priority Data

Sep. 10, 2009 (JP) ..... 2009-209193
May 31, 2010 (JP) ..... 2010-124182

(51) Int. Cl.
*G03G 15/00* (2006.01)

(52) U.S. Cl. ..... 399/389; 356/614; 399/45

(58) Field of Classification Search ..... 399/389, 399/388, 45; 356/614
See application file for complete search history.

(56) References Cited

U.S. PATENT DOCUMENTS

| | | | | |
|---|---|---|---|---|
| 5,743,521 | A | 4/1998 | Munakata et al. | 271/263 |
| 6,731,886 | B2 | 5/2004 | Takeda | 399/45 |
| 2009/0074436 | A1* | 3/2009 | Murakami | 399/45 |
| 2009/0148176 | A1* | 6/2009 | Shida | 399/45 |
| 2010/0172663 | A1* | 7/2010 | Nakai | 399/45 |

FOREIGN PATENT DOCUMENTS

| | | | |
|---|---|---|---|
| JP | 57-004062 | A * | 1/1982 |
| JP | 05-294511 | | 11/1993 |
| JP | 07-117890 | | 5/1995 |
| JP | 11-139621 | | 5/1999 |
| JP | 2002-340518 | | 11/2002 |
| JP | 2003-118889 | | 4/2003 |
| JP | 2005-170640 | | 6/2005 |
| JP | 2008-094600 | | 4/2008 |
| JP | 2008-254855 | | 10/2008 |

* cited by examiner

*Primary Examiner* — Sophia S Chen
(74) *Attorney, Agent, or Firm* — Harness, Dickey & Pierce, P.L.C.

(57) ABSTRACT

The sheet thickness detector includes a fixed member, a displacement roller disposed opposite the fixed member and movable in such a linear direction as to be contacted with or separated from the fixed member when the sheet passes through a nip therebetween, bearings rotatably supporting a shaft of the displacement roller, a displacement member movable in the linear direction in conjunction with the displacement roller and integrated with at least one of the bearings, and a displacement sensor operatively connected to the displacement member and detecting displacement of the displacement member. The thickness of the sheet passing through the nip is determined based on the amount of displacement of the displacement member.

15 Claims, 18 Drawing Sheets

SHEET THICKNESS DETECTOR AND IMAGE FORMING APPARATUS USING SAME

BACKGROUND OF THE INVENTION

1. Field of the Invention

The present invention relates to a sheet thickness detector for determining the thickness of a sheet, and to an image forming apparatus using the sheet thickness detector.

2. Discussion of the Related Art

Electrophotographic image forming apparatuses, in which a toner image formed on an image bearing member is transferred onto a receiving sheet and the toner image is then fixed thereto by a fixing device, are known. When plain paper having a normal thickness and thick paper are used as the receiving sheet for such image forming apparatuses, the image forming apparatuses typically perform controlling operations such that the transfer conditions and fixation conditions are changed depending on the thickness of the receiving sheet used. Specifically, such image forming apparatuses determine the thickness of the receiving sheet using a sheet thickness detector, and control the transfer conditions and fixation conditions depending on the thickness of the receiving sheet. Such a sheet thickness detector is required to provide high detection precision at low cost.

It is also preferable for image forming apparatuses other than the above-mentioned electrophotographic image forming apparatuses to determine the thickness of a receiving sheet to perform controlling operations depending on the thickness of the receiving sheet used. For example, some inkjet recording apparatuses determine the thickness of a receiving sheet to perform a controlling operation such that a predetermined distance, or gap, between the surface of the sheet and the surface of the inkjet recording head is maintained even when the thickness of the receiving sheet changes.

Thus, it is known to determine the thickness of a sheet used for image formation. Specific examples of such sheet thickness detectors include devices in which a lever (terminal) of a contact displacement sensor is directly contacted with a movable roller (hereinafter referred to as a displacement roller) to determine the amount of displacement of the roller caused by the sheet, and thus the thickness of the sheet. However, the accuracy of such contact-type sensors is known to deteriorate over time.

Non-contact types of sheet thickness detectors are also known that use optical, magnetic, or other technologies to detect sheet thickness. Specific examples of such non-contact types of sheet thickness detectors include a device measuring the amount of displacement of a displacement roller using a non-contact displacement sensor; a device determining the thickness of a sheet depending on the amount of light passing through the sheet; a device detecting a sheet having a thickness greater than a predetermined thickness depending on whether a flag provided on an end of a lever contacted with a displacement roller and swinging due to swinging of the displacement roller interrupts an optical sensor; and a device measuring the amount of displacement of a displacement roller using a non-contact magnetic displacement sensor.

SUMMARY

This patent specification describes a novel sheet thickness detector for determining the thickness of a sheet, one embodiment of which includes a fixed member, a displacement roller movable in such a linear direction as to be contacted with or separated from the fixed member when the sheet passes through a nip therebetween, bearings rotatably supporting the shaft of the displacement roller, a displacement member movable in the linear direction in conjunction with the displacement roller, and a displacement sensor configured to detect displacement of the displacement member to determine the thickness of the sheet passing through the nip. The moving direction of the displacement roller is the same as the moving direction of the displacement member. In addition, the displacement member is integrated with at least one of the bearings.

This patent specification further describes a novel image forming apparatus, one embodiment of which includes an image forming device configured to form a visible image on a sheet, a sheet feeding device configured to feed the sheet to the image forming device, and the above-mentioned sheet thickness detector. The sheet thickness detector determines the thickness of the sheet before the image is formed on the sheet.

BRIEF DESCRIPTION OF THE DRAWINGS

A more complete appreciation of aspects of the invention and many of the attendant advantage thereof will be readily obtained as the same become better understood by reference to the following detailed description when considered in connection with the accompanying drawings, wherein.

DESCRIPTION OF THE PREFERRED EMBODIMENTS

Figure 1:
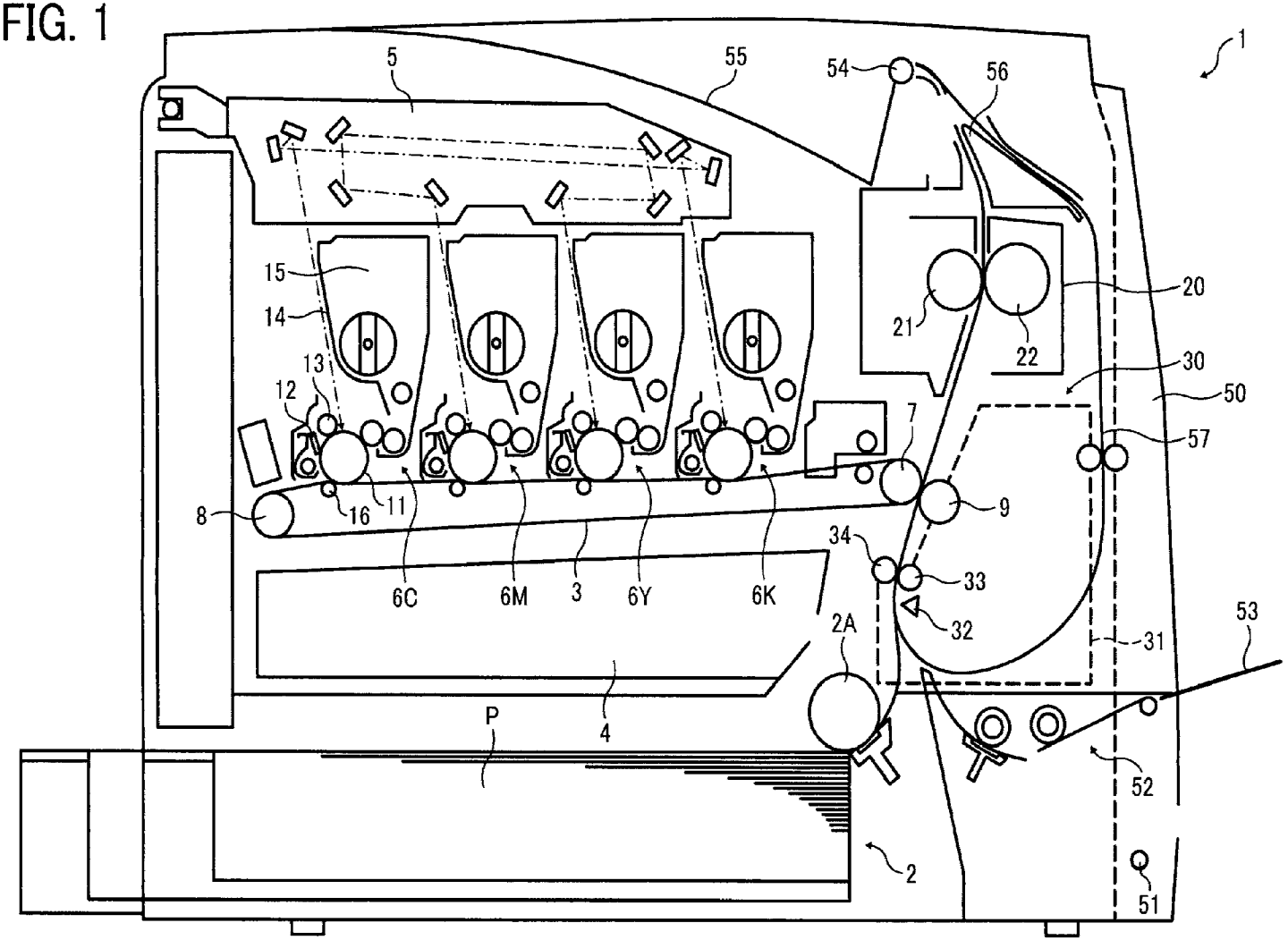
FIG. 1 is a schematic view illustrating a color image forming apparatus as one example of an image forming apparatus of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element (s) or feature (s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, example embodiments of the present patent application are described.

The present invention will now be described in detail with reference to the accompanying drawings.

FIG. 1 is a schematic cross-sectional view illustrating a color image forming apparatus as one example of the image forming apparatus of the present invention. Referring to FIG. 1, a color image forming apparatus 1 has four image forming units 6 (6C, 6M, 6Y, and 6K) in a central portion thereof; a light irradiating device 5 located above the image forming units 6 to form latent images on photoreceptors 11 of the image forming units; and a transfer device including an intermediate transfer belt 3 serving as a primary transfer member, which is tightly stretched across plural support rollers 7 and 8 so as to rotate counterclockwise, and a secondary transfer member 9 opposed to the support roller 7 with the intermediate transfer belt 3 therebetween.

Since the image forming units 6C, 6M, 6Y, and 6K have the same configuration and perform the same operations except that the toners used therefor have different colors, i.e., cyan (C), magenta (M), yellow (Y), and black (K) colors, description will be made while omitting the suffixes C, M, Y, and K.

At the bottom of the image forming unit 6, the photoreceptor drum 11 serving as an image bearing member is arranged so as to be opposed to the intermediate transfer belt 3, and is rotated clockwise by a driving device (not shown). In addition, a cleaning device 12 for scraping off toner particles remaining on the photoreceptor drum 11 after a primary toner image transferring operation; a charging device 13 contacted with the photoreceptor drum to charge the photoreceptor drum; and a developing device 14 for developing a latent image on the photoreceptor drum with a developer to form a toner image thereon, are arranged around the photoreceptor drum. The developing device 14 has a fresh toner chamber 15, which is arranged in the central portion of the developing device and contains fresh toner consisting of toner particles having a predetermined color (C, M, Y, or K). Further, a primary transfer member 16 for primarily transferring a color toner image from the photoreceptor drum 11 to the intermediate transfer belt 3 is arranged so as to be opposed to the photoreceptor drum with the intermediate transfer belt therebetween.

The color image forming apparatus 1 further has a waste toner tank 4 for containing waste toners collected when cleaning the photoreceptor drums and intermediate transfer belt 3, and a sheet feeding device 2 for feeding receiving sheets P such as paper sheets to the image forming units 6, which are arranged below the intermediate transfer belt. The thus-fed sheet P is timely forwarded to the secondary transfer member 9 so that the color toner images on the intermediate transfer belt 3 are transferred onto a proper position of the sheet P by a sheet feeding device 30 mentioned below. In this regard, a transfer bias current of from 5 μA to 39 μA is applied to the secondary transfer member 9, wherein the current is determined depending on the ambient conditions for the image forming apparatus, size and thickness of the sheet P, speed of feeding the sheet P, etc.

In a full color image forming operation, C, M, Y, and K color images are formed on the respective photoreceptor drums 11, and then transferred sequentially to the intermediate transfer belt 3.

The sheet P to which color images are transferred is then fed to a fixing device having a fixing roller 21 and a pressure roller 22 opposed to the fixing roller so that the toner images are fixed to the sheet upon application of heat and pressure thereto. In this regard, the temperature of the surface of the fixing roller 21 is about 150° C. to about 200° C., which is also determined depending on the ambient conditions for the image forming apparatus, size and thickness of the sheet P, speed of feeding the sheet P, etc.

In the image forming apparatus, the light irradiating device 5, image forming units 6, transfer device including the intermediate transfer belt 3 and primary and secondary transfer members 16 and 9, fixing device 20, etc., serve as an image forming device configured to form a visible image on a sheet.

Figure 2:
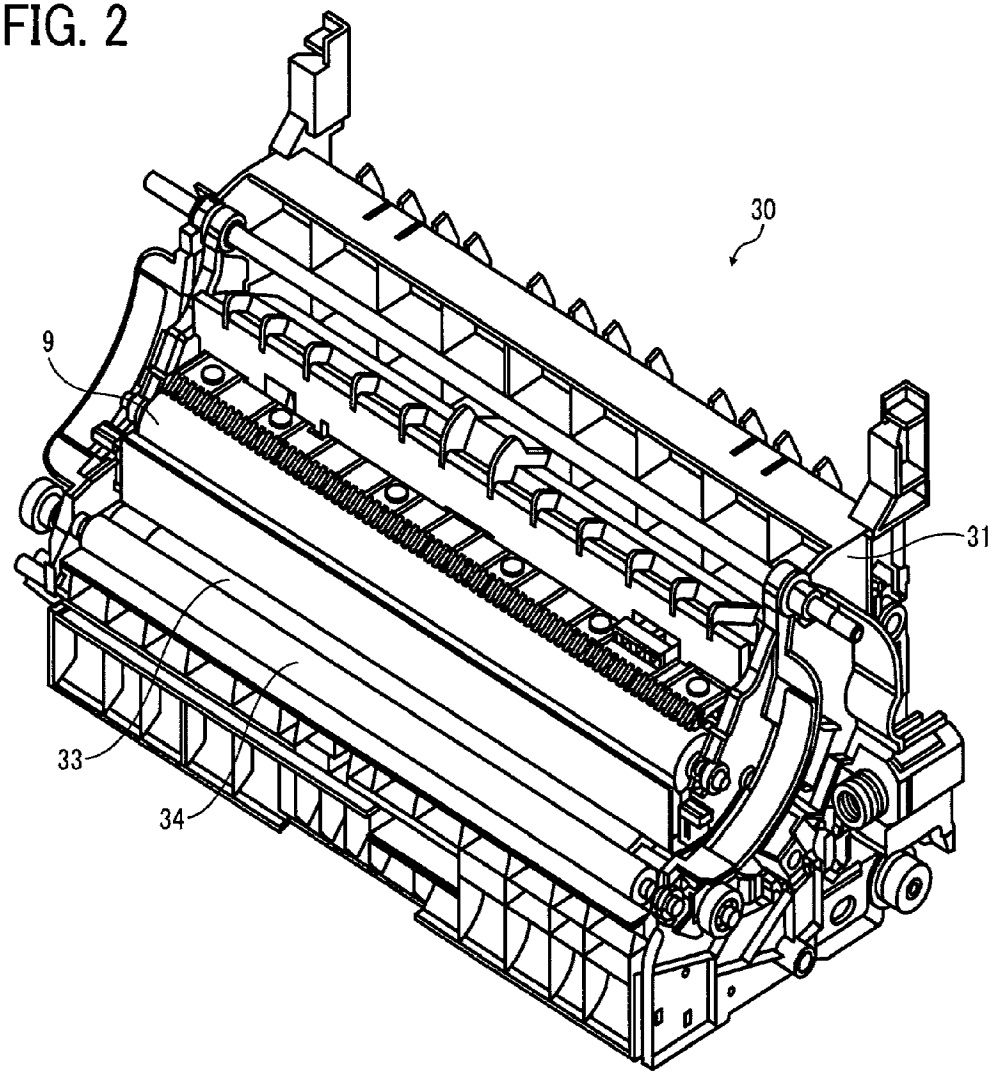
FIG. 2 is a perspective view illustrating a sheet feeding device of the image forming apparatus illustrated in FIG. 1.

As illustrated in FIG. 2, the above-mentioned sheet feeding device 30 is a unit having a case 31, a pair of registration rollers 33 and 34 for timely feeding the sheet P to the secondary transfer member 9, a sensor 32 (illustrated in FIG. 1) for detecting whether the sheet reaches the pair of registration rollers, the secondary transfer member, a guide for feeding the sheet P, etc.

Figure 3:
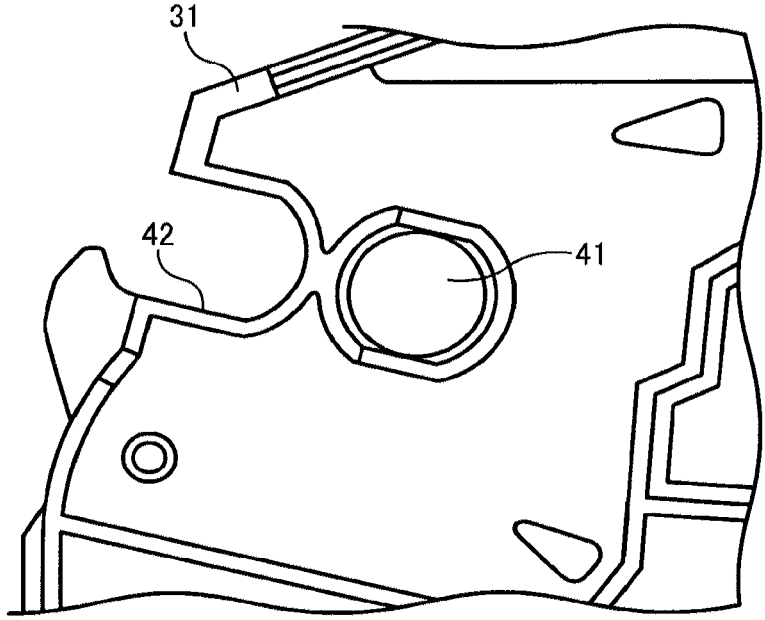
FIG. 3 is a schematic view illustrating a support member for supporting registration rollers of the sheet feeding device illustrated in FIG. 2.
Figure 9A:
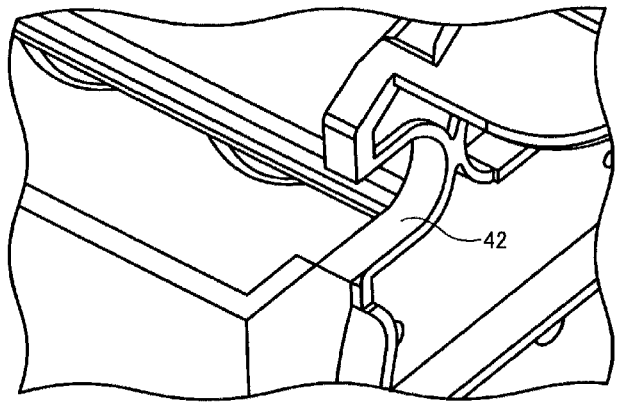
FIGS. 9A-9C are views illustrating restriction on rotation of the displacement member illustrated in FIG. 5.
Figure 9B:
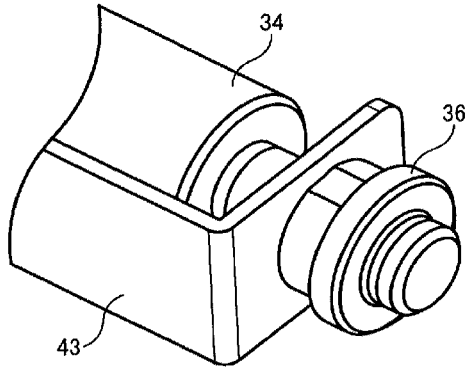

Referring back to FIG. 1, the image forming apparatus of the present invention includes a sheet thickness detector provided at a location between the sheet feeding device 2 and the secondary transfer member 9 to determine the thickness of the sheet P fed by the sheet feeding device. In this color image forming apparatus 1, the pair of registration rollers 33 and 34 is used for the sheet thickness detector, wherein the registration roller 33 is used as a fixed member, and the registration roller 34 is used as a displacement roller, which is contacted with the registration roller 33 while being movable in such a direction as to be separated from the registration roller 33. Specifically, as illustrated in FIGS. 3 and 9A, the registration roller 33 is supported by a roller holding portion 41, which is a circular hole formed in the case 31 and whose position is fixed, while the registration roller 34 is supported by a displacement roller holding portion 42, which is a concavity formed in the case 31.

Figure 4:
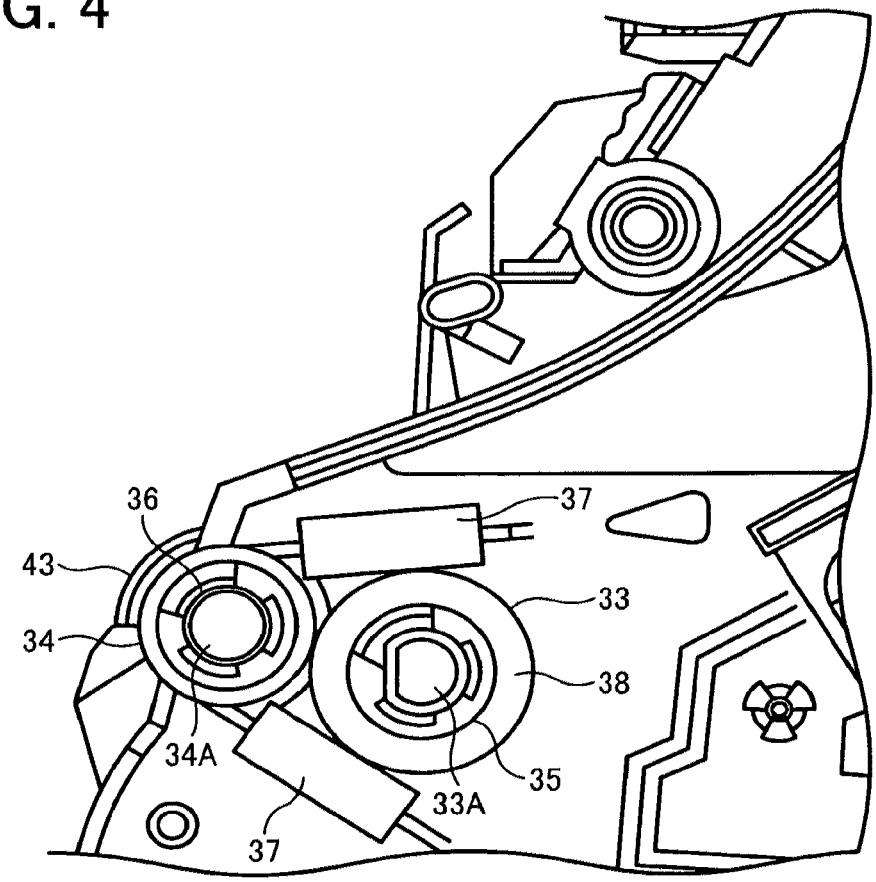
FIG. 4 illustrates the support member with the registration rollers attached.

More specifically, as illustrated in FIG. 4, a shaft 33A of the registration roller 33 is engaged with the roller holding portion 41 via a bearing 35, and a shaft 34A of the registration roller 34 is movably engaged with the displacement roller holding portion 42 via a bearing 36. In this regard, the movement of the displacement registration roller 34 is thus restricted to a direction in which the concavity (i.e., the displacement roller holding portion 42) extends. Since the moving direction is the same as the direction of a line connecting the centers of the registration rollers 33 and 34, the registration roller 34 is supported by the displacement roller holding portion 42 so as to be movable only in that direction relative to the registration roller 33.

As illustrated in FIG. 4, the registration roller 34 is biased by a spring 37 in such a direction as to be contacted with the registration roller 33 via a bearing 36, thereby imparting a sheet nipping pressure to the pair of registration roller 33 and 34. A driving force applied by a driving source provided on the main body of the image forming apparatus 1 to a driving gear 38 provided at an end of the registration roller 33 rotates the pair of registration rollers 33 and 34, thereby feeding the sheet P. In addition, an idler gear (not shown) is provided on each of the other ends of the registration rollers 33 and 34 to transmit the driving force applied to the registration roller 33 to the displacement registration roller 34 via the idler gears.

In an image forming operation, the sheet P fed from the sheet feeding device 2 and detected by the sensor 32 strikes the nip between the pair of registration rollers 33 and 34, which is stopped. When the tip of the sheet P strikes the stopped registration rollers 33 and 34 and a feed roller 2A of the sheet feeding device 2 further feeds the sheet in a predetermined length, the feed roller is stopped to bend the sheet at a passage between the registration rollers and the feed roller, thereby correcting skew of the sheet caused by the sheet feeding device. The pair of registration rollers 33 and 34 is then driven to timely rotate, so that a toner image on the intermediate transfer belt 3 is transferred onto a proper position of the sheet P by the secondary transfer member 9.

In the example of the image forming apparatus illustrated in FIG. 1, the case 31 of the sheet feeding device 30 is detachably attached to a cover 50 of the image forming apparatus 1, which opens to allow access to the interior of the image forming apparatus. By rotating the cover 50 on a hinge 51 provided on the image forming apparatus 1, the sheet feeding device 30 can be exposed while detached from the image forming apparatus, so that cleaning and maintenance operations can be performed on the sheet feeding device.

As illustrated in FIG. 1, the image forming apparatus 1 has a manual sheet feeding device 52 as well as the sheet feeding device 2 having a sheet cassette. Similarly to the sheet feeding device 2, the manual sheet feeding device 52 feeds the sheet P set on a manual sheet tray 53 toward the secondary transfer member 9.

After a toner image is transferred onto the sheet P by the secondary transfer member 9, the sheet P is fed to the fixing device 20, by which the toner image is fixed on the sheet upon application of heat and pressure thereto. The sheet P bearing the fixed image is then discharged to a copy tray 55 formed on an upper surface of the image forming apparatus 1. When a duplex printing mode is adopted, the sheet P bearing the fixed image thereon is switched back by reversely rotating a discharging roller 54 so as to be fed to a reverse passage 57 after the rear edge of the sheet bearing the fixed image thereon passes a branch point 56. The sheet P fed to the reverse passage 57 is fed again to the pair of registration rollers 33 and 34 so that another image forming operation is performed on the backside of the sheet P, resulting in formation of a duplex print.

Next, the sheet thickness detector of the present invention will be described.

Figure 5:
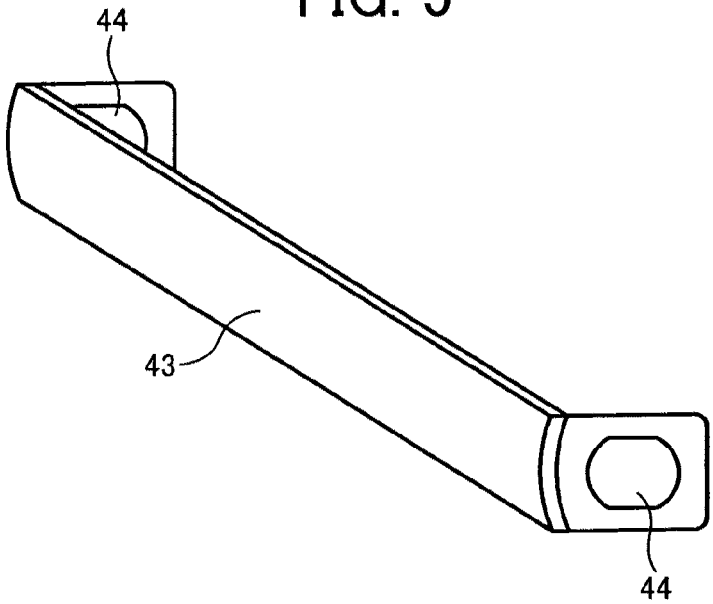
FIG. 5 is a perspective view illustrating a displacement member of the sheet feeding device illustrated in FIG. 2.
Figure 6:
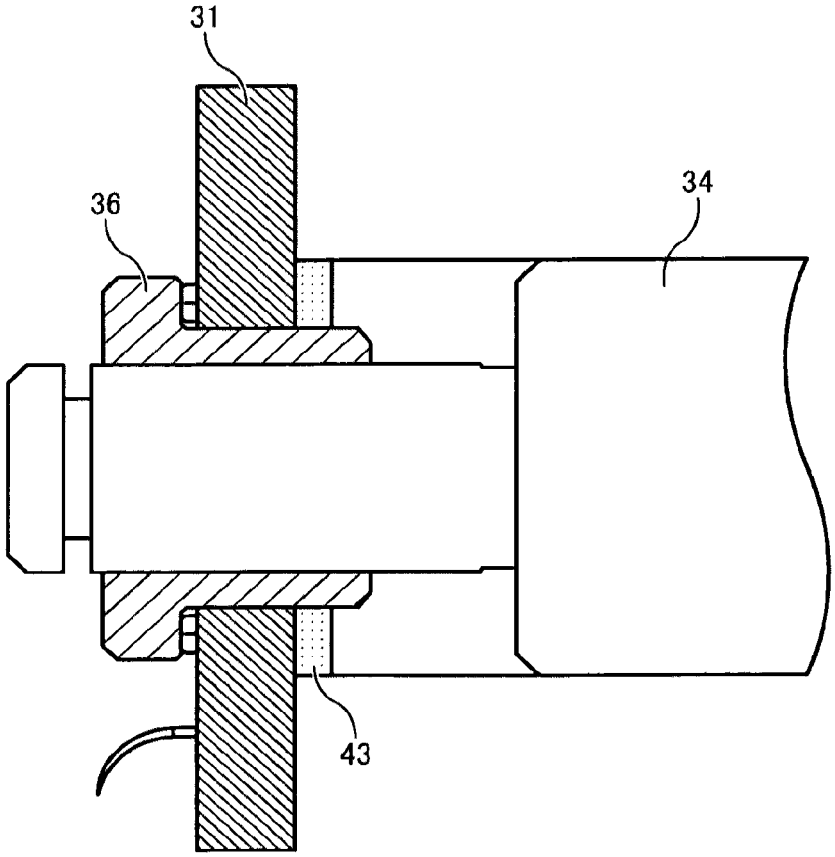
FIG. 6 is an enlarged view illustrating a shaft of a displacement roller of the registration rollers, to which the displacement member is attached.

In the above-mentioned example of the image forming apparatus, the sheet thickness detector is provided on the pair of registration rollers 33 and 34. Specifically, a displacement member 43, which is illustrated in FIGS. 4 and 5 and which moves in conjunction with the registration roller 34, is attached to the bearing 36 of the registration roller 34 as illustrated in FIG. 6.

The displacement member 43 is a strip-shaped plate having a longer length than the registration roller 34 in the axial direction of the roller 34, and both the ends of the displacement member are bent toward the center of the shaft of the registration roller 34 (i.e., the ends of displacement member are bent at an angle of about 90° to the long central portion thereof). Each of the bent portions of the displacement member 43 has a hole 44 to be engaged with the bearing 36 as illustrated in FIG. 5.

Figure 7:
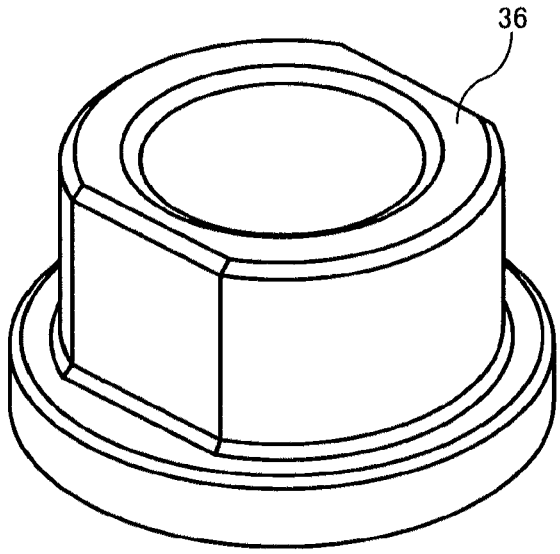
FIG. 7 is a perspective view illustrating a bearing of the displacement roller of the registration rollers illustrated in FIG. 4.
Figure 9C:
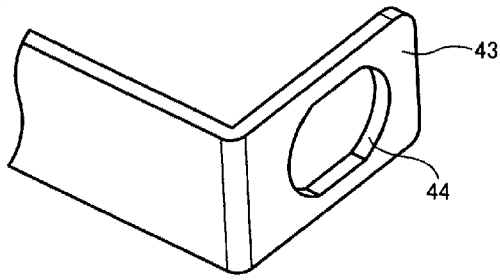

The bearing 36 is a general-purpose slide bearing with an oval flange as illustrated in FIG. 7, i.e., a bearing with a flange having two parallel planes on the circumferential surface thereof. Similarly, the hole 44 to be engaged with the bearing 36 also has an oval form as illustrated in FIG. 9C. Therefore, the hole 44 can be precisely engaged with the bearing 36 while preventing rotation of the displacement member 43. Thus, the displacement member 43 can move (i.e., displace) in conjunction with the registration roller 34.

Figure 8:
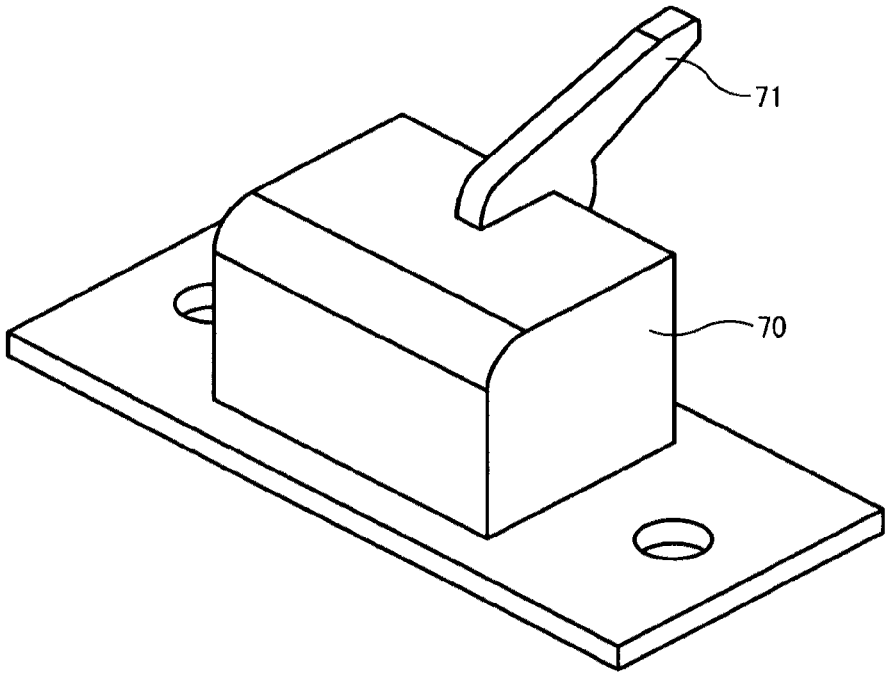
FIG. 8 is a perspective view illustrating a displacement sensor of the sheet feeding device illustrated in FIG. 2.

This example of the sheet thickness detector of the present invention includes a displacement sensor 70 as illustrated in FIG. 8. The displacement sensor 70 has a terminal 71, and an encoder (not shown) provided inside the sensor. The encoder can determine the amount of displacement of a member from the angle of the terminal 71 contacted with the member. Since the sensor 70 has a detection resolution of 6 μm or a better, the sensor has a precision sufficient for determining the thickness of sheets used as the sheet P.

By setting the displacement sensor 70 at a location such that the sensor is contacted with the displacement member 43 while detecting movement (displacement) of the member, the thickness of the sheet P nipped by the pair of registration rollers 33 and 34 can be determined. In addition, since rotation of the displacement member 43 is restricted by engagement of the oval bearing 36 with the oval hole 44, abrasion of the terminal 71 can be relatively reduced compared to a case where the terminal is contacted directly with a surface of the rotated registration roller 34.

Next, a preferred arrangement of the displacement sensor 70 and the displacement member 43 will be described.

Figure 10:
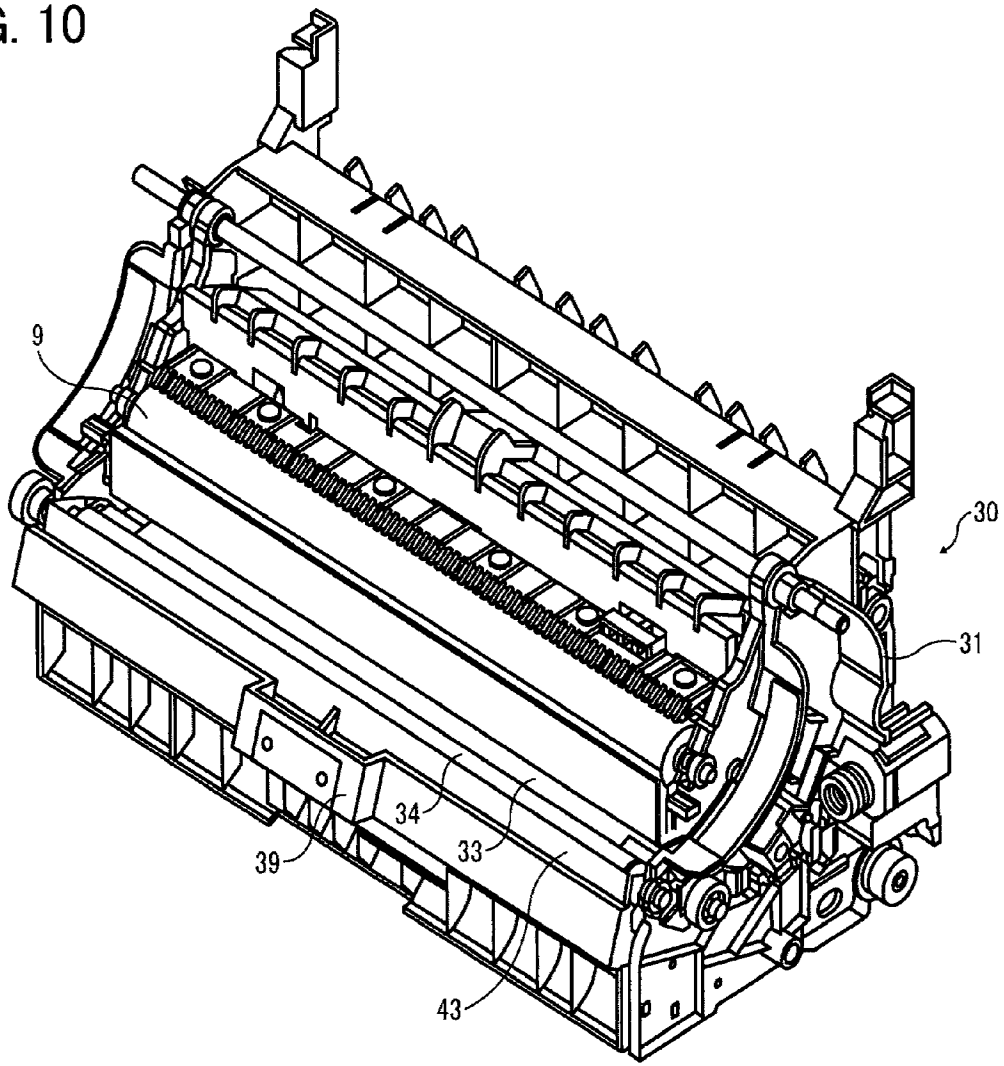
FIG. 10 is a perspective view illustrating a sheet feeding device to which the displacement sensor illustrated in FIG. 8 is attached.
Figure 11:
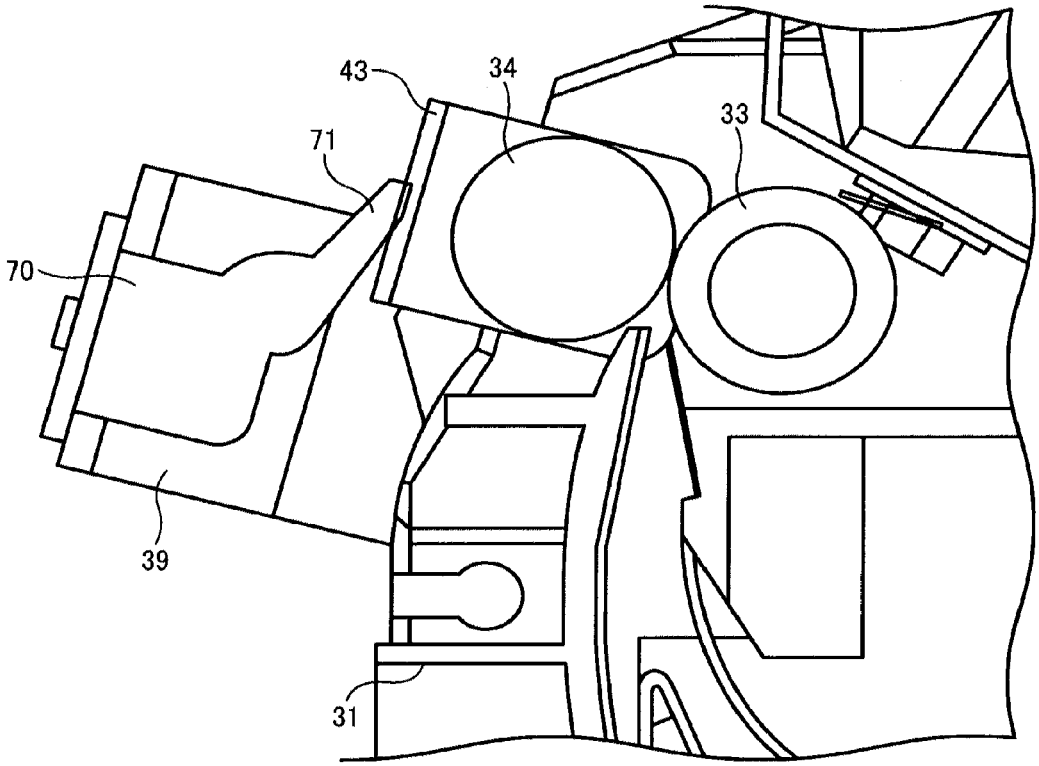
FIG. 11 is a cross-sectional view illustrating a displacement roller, a displacement member, and a displacement sensor of an example of the sheet thickness detector of the present invention.

Referring to FIGS. 10 and 11, the displacement sensor 70 is fixed to a mounting portion 39 integrated with or fixed to the case 31 of the sheet feeding device 30 in such a manner that the terminal 71 is contacted with the displacement member 43 while opposed thereto. In this regard, electric power supply and signal transmission are performed using a point of contact (not shown), at which the case 31 of the sheet feeding device 30 can be contacted with or released from the main body of the image forming apparatus 1.

It is preferable to set the displacement sensor 70 on the mounting portion 39 in such a manner that the pressing direction of the terminal 71 is identical to the displacement direction of the registration roller 34, and the point of contact of the tip of the terminal 71 with the displacement member 43 is located on an extension of the line connecting the centers of the registration rollers 33 and 34 as illustrated in FIG. 11.

Thus, the roller holding portion 41 supporting the registration roller 33 serving as a fixed member, the displacement roller holding portion 42 supporting the registration roller 34 serving as a displacement roller, and the sensor mounting portion 39 are provided on the case 31 of the sheet feeding device 30 (i.e., the sensor is attached to a restriction member (i.e., case 31) for restricting movement (rotation) of the displacement member), and therefore the displacement sensor 70 can be arranged with high positional precision.

Next, another example of the displacement member will be described.

Figure 12:
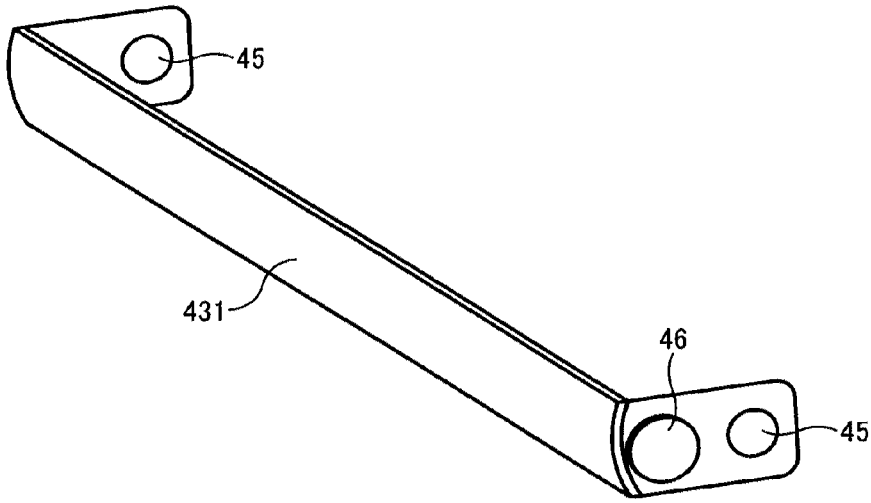
FIG. 12 is a perspective view illustrating another displacement member for use in the sheet thickness detector of the present invention.
Figure 13:
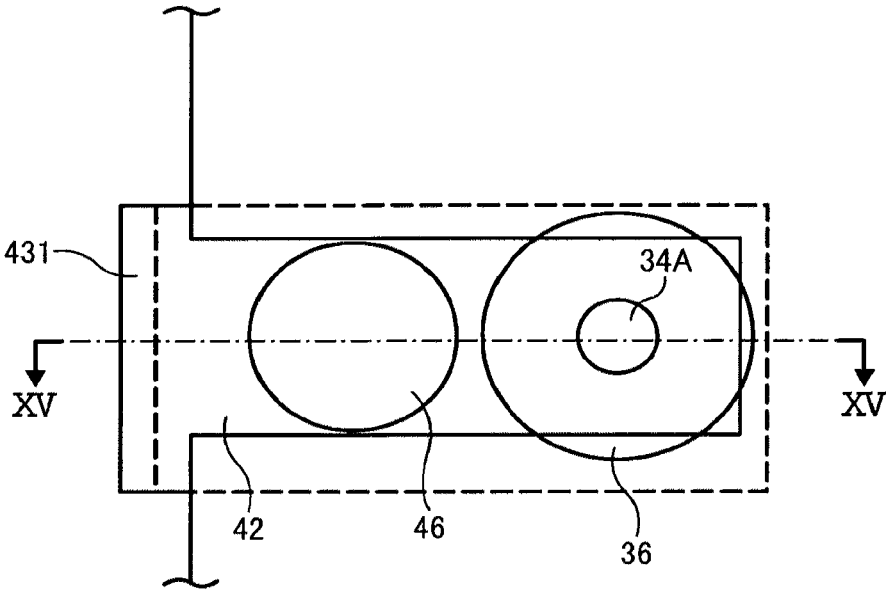
FIG. 13 is a schematic view illustrating a portion of the sheet thickness detector for restricting movement of the displacement member illustrated in FIG. 12.
Figure 14:
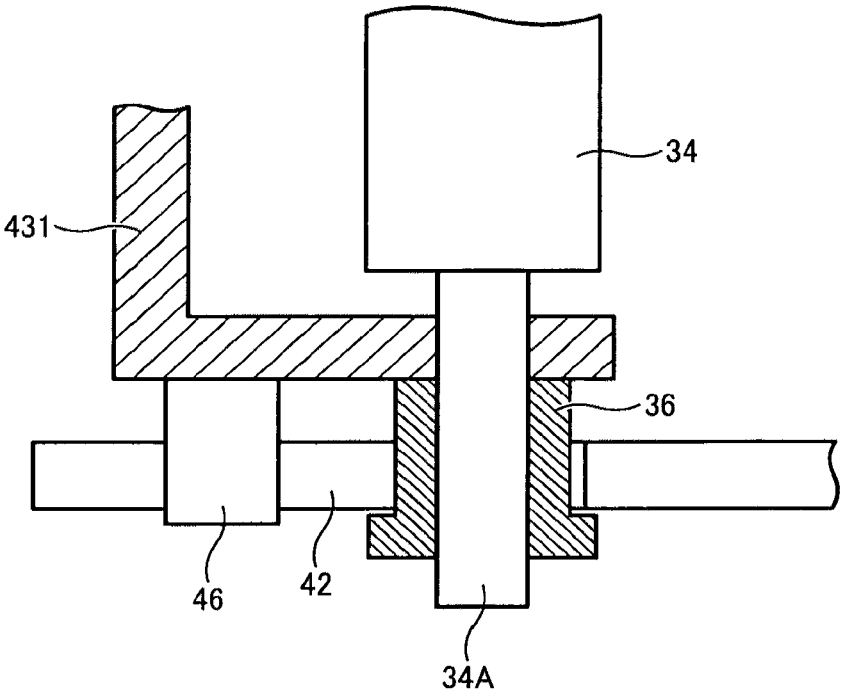
FIG. 14 is a cross-sectional view of the movement restricting portion illustrated in FIG. 13 along a line XV-XV.

Referring to FIGS. 12-14, each of the folded end portions of a displacement member 431 has a hole 45 to be engaged with the shaft 34A of the registration roller 34, and a rotation restriction pin 46 which is arranged at a location closer to the fold line than the location of the hole 45 and which serves as a restriction member for restricting rotation of the displacement member 43. As illustrated in FIG. 14, the rotation restriction pin 46 is inserted into the concavity (groove) of the displacement roller holding portion 42 similarly to the bearing 36 having an oval flange, and the diameter of the pin is the same as the width of the shorter side of the concavity (groove) of the holding portion 42.

The displacement member 431 set as illustrated in FIG. 14 can follow the movement of the registration roller 34 in the extending direction of the concavity (groove) of the displacement roller holding portion 42 while rotation thereof is restricted by the rotation restriction pin 46.

Figure 15:
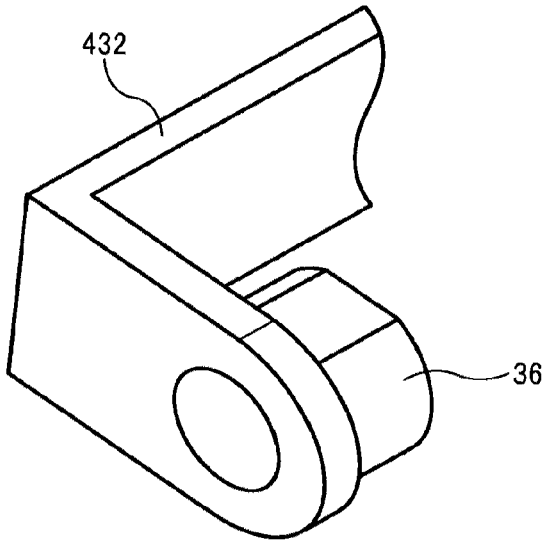
FIG. 15 is a perspective view illustrating yet another displacement member for use in the sheet thickness detector of the present invention.

FIG. 15 illustrates yet another example of the displacement member. As illustrated in FIG. 15, the bearing 36 of the registration roller 34 is fixed to a displacement member 432 instead of the case 31 of the sheet feeding device 30. Since the bearing 36 has the above-mentioned oval flange, the displacement member 432 can follow the movement of the registration roller 34 while rotation thereof is restricted.

Next, the contact surface of the displacement member with the displacement sensor 70 will be described.

Figure 16:
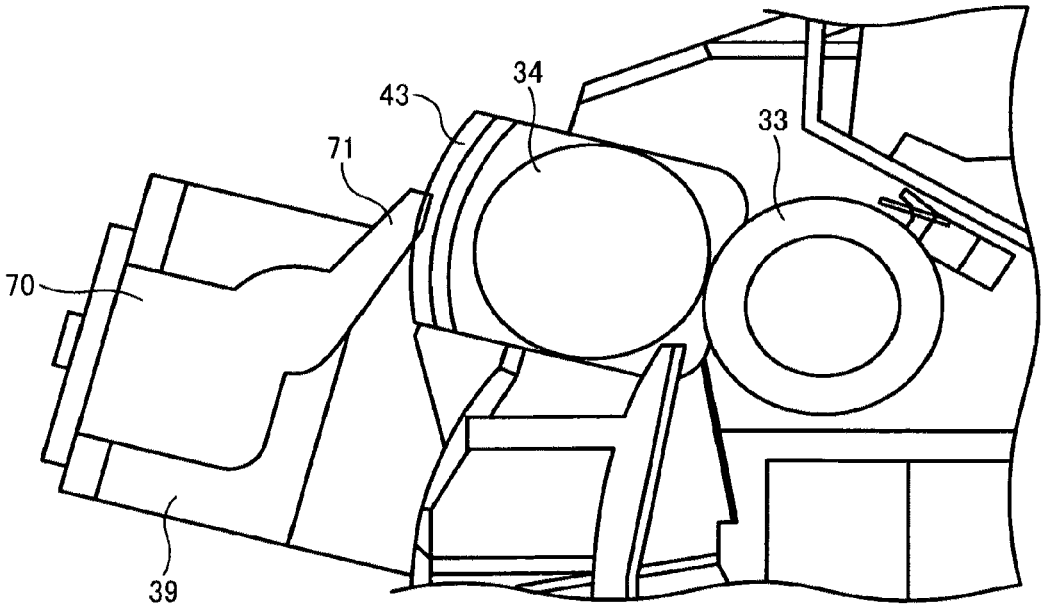
FIG. 16 is a schematic view illustrating a displacement member contacted with a displacement sensor in another example of the sheet thickness detector of the present invention.

As illustrated in FIG. 16, the contact surface of the displacement member 43 is curved while having a larger curvature than the circumferential surface of the registration roller 34.

When the terminal 71 of the displacement sensor 70 is contacted with the contact surface of the displacement member 43, movement of the point of contact of the terminal with the contact surface due to movement of the displacement member is smaller than in a case where the terminal is directly contacted with the registration roller 34, thereby reducing detection error of the sensor. In addition, the degree of deformation (abrasion) of the contact surface of the displacement member 43 can be reduced.

Next, the detection error caused by movement in the position of the point of contact of the terminal 71 will be described.

Figure 17:
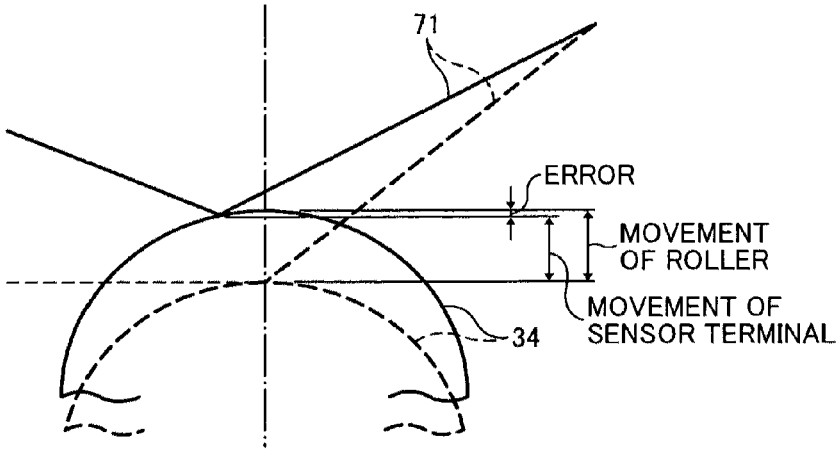
FIG. 17 is a schematic view illustrating a contact portion of a displacement roller with a displacement sensor.

FIG. 17 is a schematic view illustrating the point of contact of the terminal 71 with a surface of the registration roller 34.

Referring to FIG. 17, the position of the terminal 71 of the displacement sensor 70 and the registration roller 34 before movement is illustrated with a broken line, and the position thereof after movement of the registration roller is illustrated with a solid line.

When the registration roller 34 moves from the initial state illustrated with the broken line in FIG. 17 to the state illustrated with the solid line, the point of contact of the terminal 71 of the displacement sensor 70 with the surface of the registration roller also moves as illustrated in FIG. 17. In this case, the moving distance of the registration roller 34 is different from that of the terminal 71, thereby producing an error in determining the amount of displacement of the displacement member with the displacement sensor 70.

Figure 18:
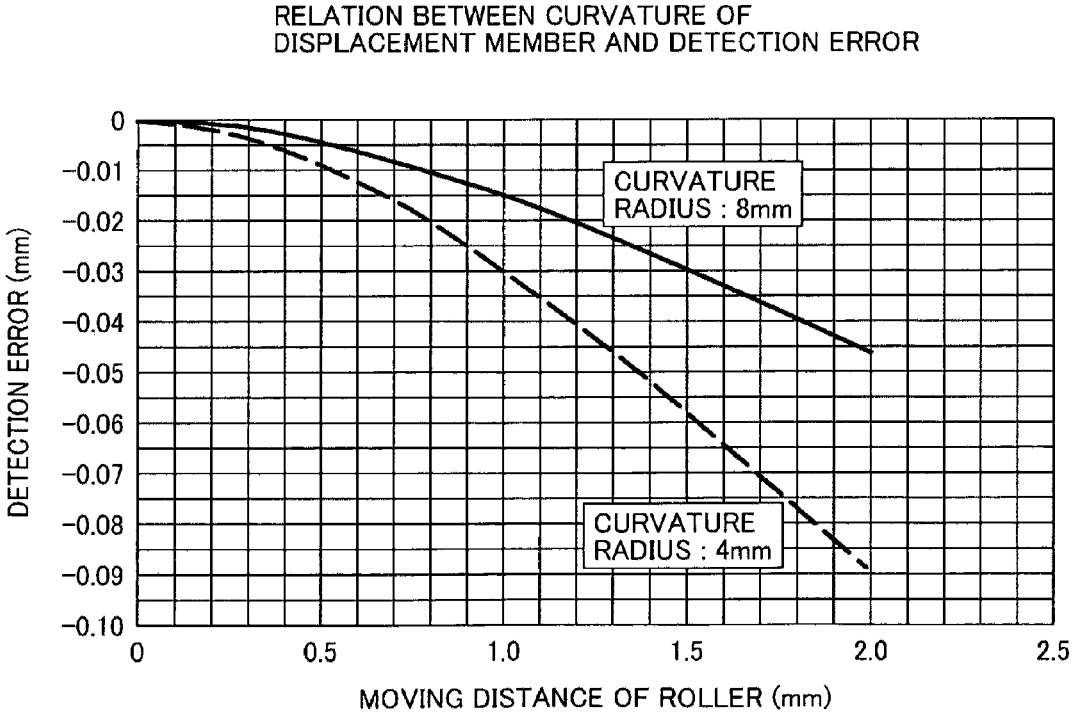
FIG. 18 is a graph illustrating a relation between curvature of the displacement member illustrated in FIG. 17 and detection error.

As illustrated in FIG. 18, the above-mentioned error increases as the moving distance of the displacement roller 34 increases, or the curvature of the surface of the displacement member 43 decreases.

In FIGS. 17 and 18, it is assumed that in the initial state (illustrated with the broken line in FIG. 17) the terminal 71 is contacted with the summit of the registration roller 34 in the moving direction of the roller. However, if the terminal 71 is contacted with another point of the registration roller 34, the error further increases.

Figure 19:
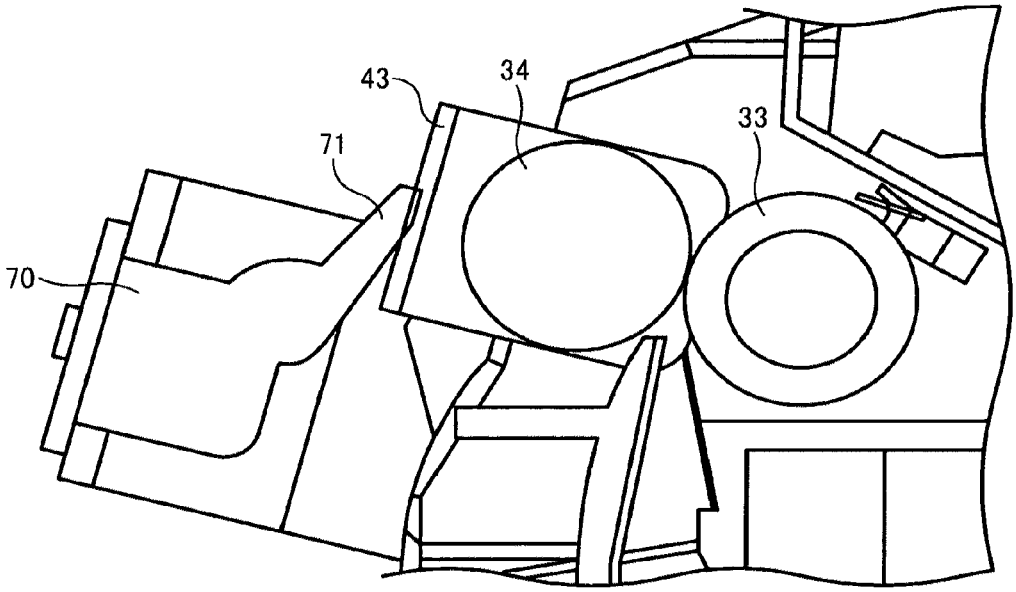
FIG. 19 is an enlarged view of the sheet thickness detector illustrated in FIG. 11 mainly illustrating the contact portion of the displacement member and the displacement sensor.

Therefore, when the contact surface of the displacement member 43 with the terminal 71 has a larger curvature than the circumferential surface of the registration roller 34, the above-mentioned error can be reduced compared to a case where the terminal is directly contacted with the circumferential surface of the registration roller. For these reasons, the surface of the displacement member 43 is preferably flat at least in a range of the surface with which the terminal 71 is contacted while moving as illustrated in FIG. 19.

Next, the image forming operations of other examples of the image forming apparatus of the present invention equipped with the sheet thickness detector of the present invention will be described. Since the image forming operation and sheet feeding operation are similar to those mentioned above, only the points of the operations are described here.

Figure 20:
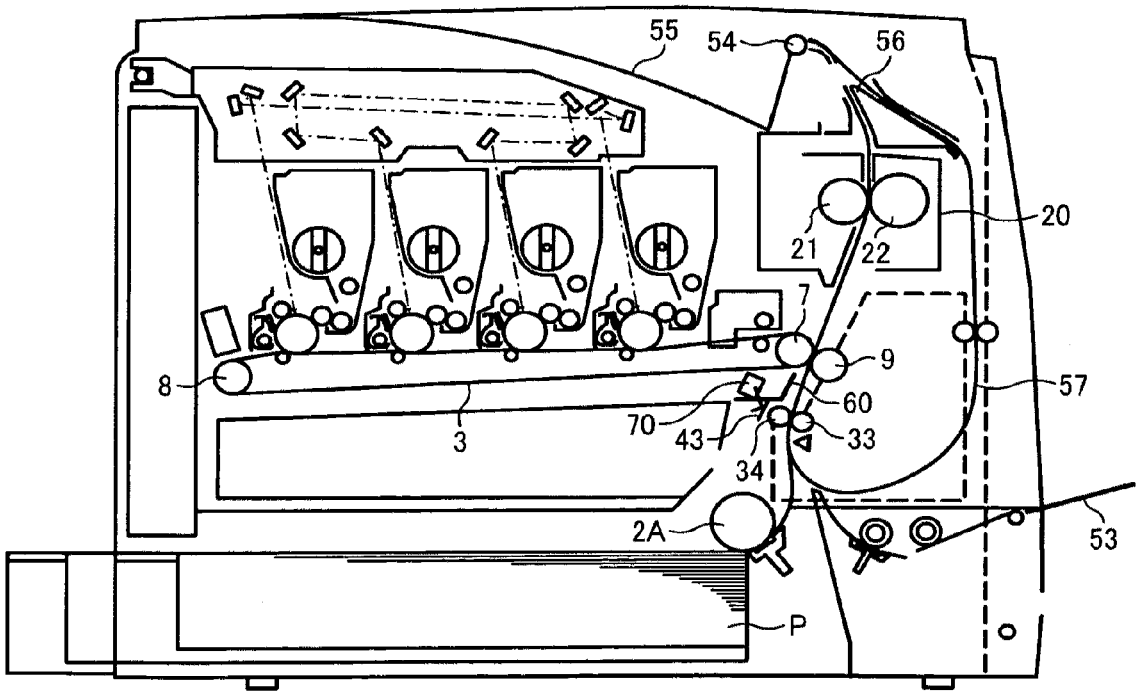
FIG. 20 is a schematic view illustrating another example of the image forming apparatus of the present invention.
Figure 21:
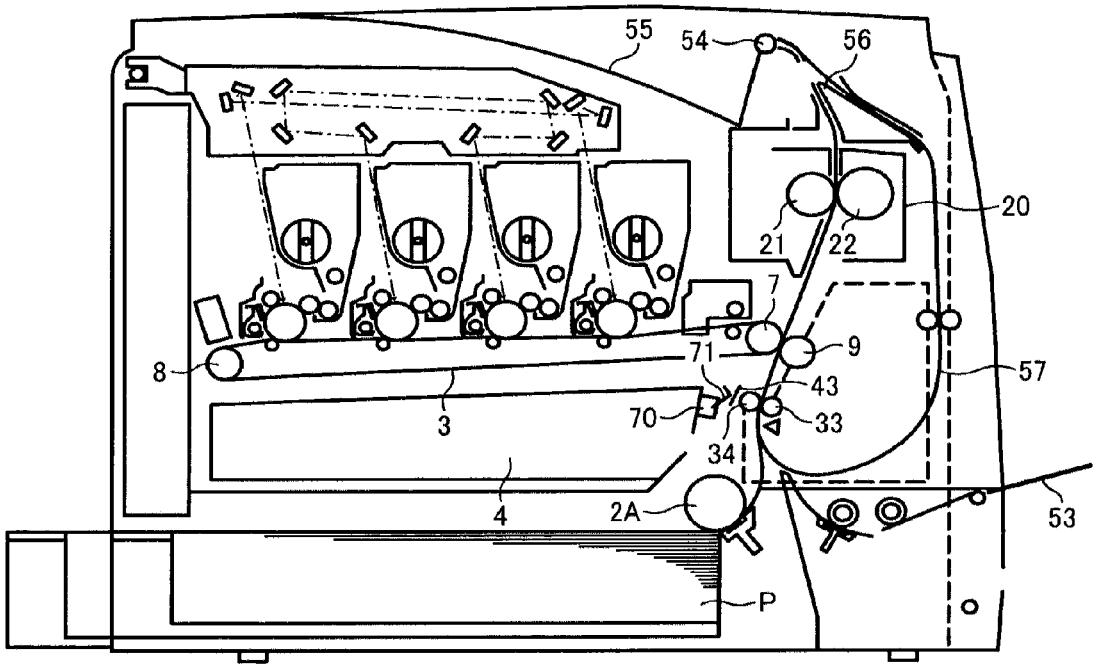
FIG. 21 is a schematic view illustrating yet another example of the image forming apparatus of the present invention.

FIGS. 20 and 21 illustrate other examples of the image forming apparatus of the present invention equipped with the sheet thickness detector of the present invention.

Referring to FIGS. 20 and 21, the sheet P fed from the sheet feeding device 2 strikes the pair of registration rollers 33 and 34, and is then bent to correct skew thereof caused by the feed roller 2A. Next, the pair of registration rollers 33 and 34 timely starts rotating to feed the sheet P toward the secondary transfer member 9 while pinching the sheet, so that a toner image on the intermediate transfer belt 3 is transferred onto the proper position of the sheet by the secondary transfer member.

When the pair of registration rollers 33 and 34 pinches the sheet P, the displacement sensor 70 determines the thickness of the sheet. The image forming apparatus automatically changes the image forming conditions depending on the thickness of the sheet P so as to be suitable for the sheet. Specific examples of the image forming conditions include the fixing temperature of the fixing device 10, and the current of the secondary transfer bias applied to the secondary transfer member 9.

Specifically, the fixing temperature is preferably about 175° C. in a case where the temperature of the surface of the fixing roller 21 (illustrated in FIGS. 20 and 21) is controlled, and the sheet P is a plain paper sheet having a normal thickness of about 0.08 mm. When the sheet P is a plain paper sheet having an intermediate thickness of about 0.1 mm, the fixing temperature is preferably about 180° C. Thus, as the thickness of the sheet P increases, the fixing temperature is increased because the heat capacity of the sheet increases.

With respect to the current of the secondary transfer bias (hereinafter referred to as secondary transfer bias current), when the paper sheet has a normal thickness of about 0.08 mm, the current is preferably set to about 14 μA. When a thick paper sheet having a thickness of about 0.17 mm is used as the sheet P, the secondary transfer bias current is preferably set to about 8 μA. Thus, the secondary transfer bias current is lowered as the thickness of the sheet P increases. This is because when the thickness of the sheet P increases, the resistance of the sheet also increases. Specifically, in order to satisfactorily transfer a toner image onto the sheet P using the secondary transfer member 9, the potential of the sheet P is preferably controlled to a certain potential. Since the potential (V) is equal to the product of the secondary transfer bias current (I) multiplied by the resistance (R) of the sheet P, when the resistance (R) of the sheet P increases, the current (I) applied to the secondary transfer member 9 is preferably decreased to control the potential to a certain desired potential.

In conventional image forming apparatus, such image forming conditions are typically set on the basis of information on the sheet input by a user to the image forming apparatus. By using the sheet thickness detector of the present invention, proper image forming conditions can be automatically set in the process of the image forming operations without such a user's inputting operation.

Since the image forming apparatuses illustrated in FIGS. 20 and 21 have the reverse passage 57 having a U-turn portion therein, it is likely that a thick sheet, which has a high stiffness, cannot be fed through the reverse passage because the force needed for feeding the sheet seriously increases at the U-turn portion.

An additional advantage of having the detector is that the image forming apparatuses determine whether a sheet used for the sheet P can pass through the reverse passage 57 (i.e., duplex printing can be performed on the sheet) depending on the results of the thickness determining operation of the displacement sensor 70. If it is determined to be impossible, the sheet is directly fed to the copy tray 55 without being fed to the reverse passage 57 to prevent jamming of the sheet in the reverse passage.

In this regard, when image formation of three or more pages is ordered, a double-sided image forming method which can be used is that at first the images of odd pages are produced on the front sides of sheets, and then the images of even pages are formed on the backsides of the discharged sheets bearing the odd page images after ordering the operator to reset the discharged sheets, for example, on the manual sheet tray 53.

As mentioned above, by providing the sheet thickness detector in an image forming apparatus, image formation can be well performed without performing a user's operation of inputting information on the sheet used.

The displacement sensor 70 is provided, for example, on a guide member 60 (illustrated in FIG. 20) or the waste toner tank 4 (illustrated in FIG. 21), which are located in the vicinity of the pair of registration rollers 33 and 34. In the image forming apparatus illustrated in FIG. 20, the guide member 60 is typically made of a resin. In such a case, the guide member 60 typically has a box form to enhance the rigidity thereof. Therefore, it is preferable to set the displacement sensor 70 in a dead space formed in the box-form guide member, resulting in effective utilization of the dead space.

In the image forming apparatus illustrated in FIG. 21, the waste toner tank 4 can have great flexibility in shape because of containing a fluid material (i.e., toner) therein. Therefore, even when the displacement sensor 70 is arranged at a location in the vicinity of the tank 4 or is directly attached to the tank, the space for the sensor can be easily formed, for example, by changing the shape of the tank, resulting in effective utilization of the limited space of the image forming apparatus.

Figure 22:
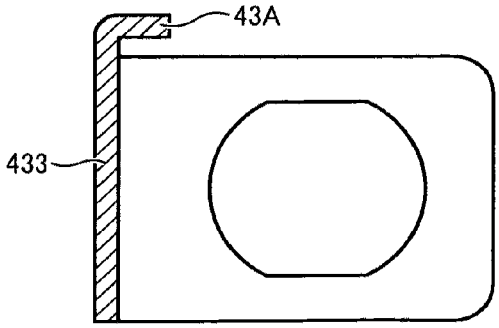
FIG. 22 is a schematic view illustrating yet another displacement member for use in the sheet thickness detector of the present invention.
Figure 23:
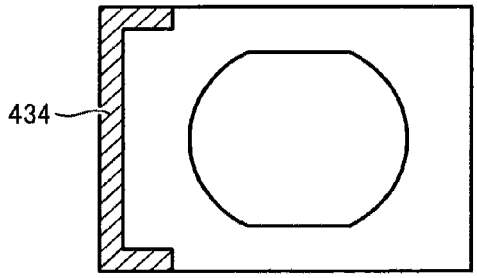
FIG. 23 is a schematic view illustrating yet another displacement member for use in the sheet thickness detector of the present invention.

The above-mentioned displacement member 43 is a strip-shaped plate having a longer length than the registration roller 34 in the axial direction of the roller. When the displacement member is made of a thin metal plate, a displacement member 433 having a curved portion 43A as illustrated in FIG. 22, which extends in a direction parallel to the axial direction of the registration roller 34, is preferably used in order to prevent deformation of the displacement member. When the displacement member is made of a resin, a displacement member 434 having a U-form as illustrated in FIG. 23 is preferably used in order to prevent deformation of the displacement member.

Figure 24:
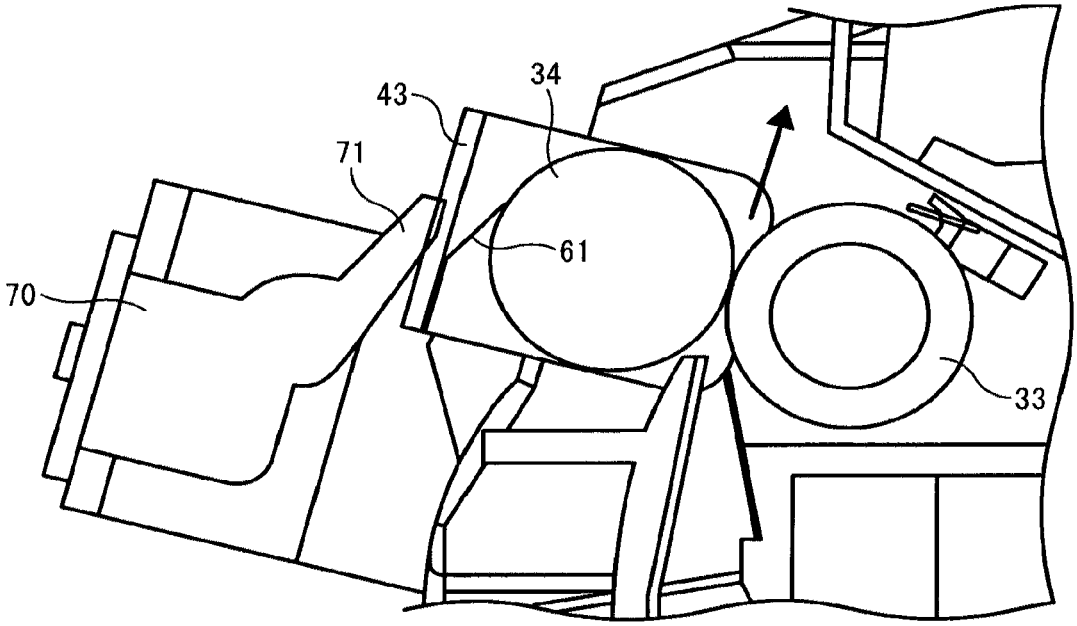
FIG. 24 is a schematic view illustrating a cleaner for cleaning a displacement roller.
Figure 25:
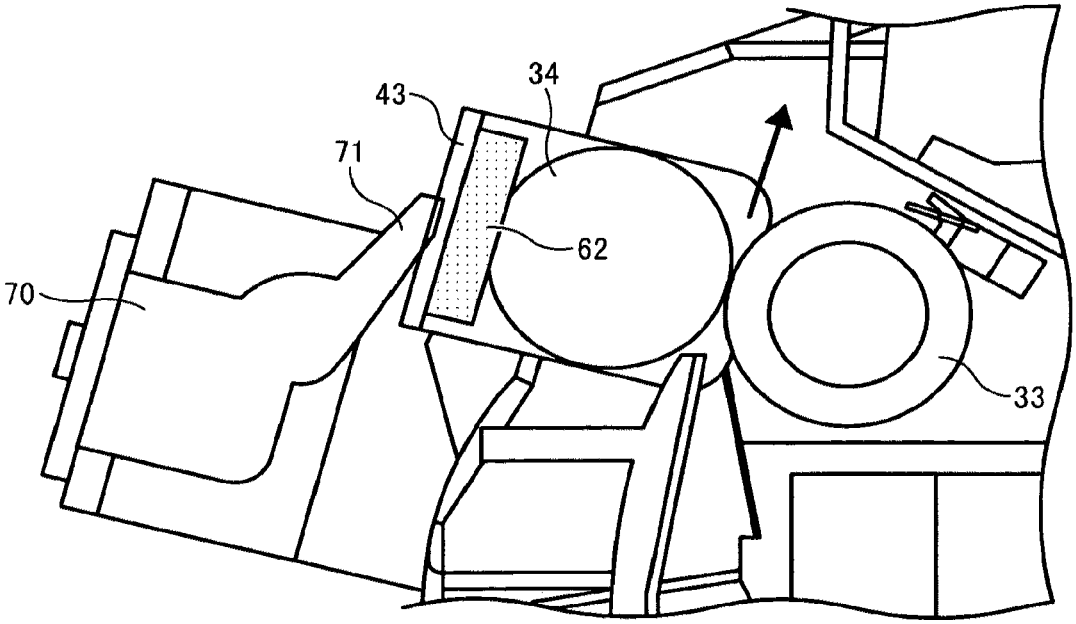
FIG. 25 a schematic view illustrating another cleaner for cleaning a displacement roller.

It is preferable to set a cleaner on the backside of the displacement member 43 to clean the surface of the registration roller 34. For example, a resin sheet 61 rubbing the surface of the registration roller 43 is provided as the cleaner as illustrated in FIG. 24 or an elastic member 62 made of a foamed material such as sponge is provided as illustrated in FIG. 25. By providing such a cleaner, foreign materials (such as paper dust) adhered to the registration roller 34 can be removed therefrom, resulting in reduction of the sheet thickness determination error (i.e., error in moving distance of the registration roller 34) caused by the foreign materials adhered to the registration roller.

Figure 26:
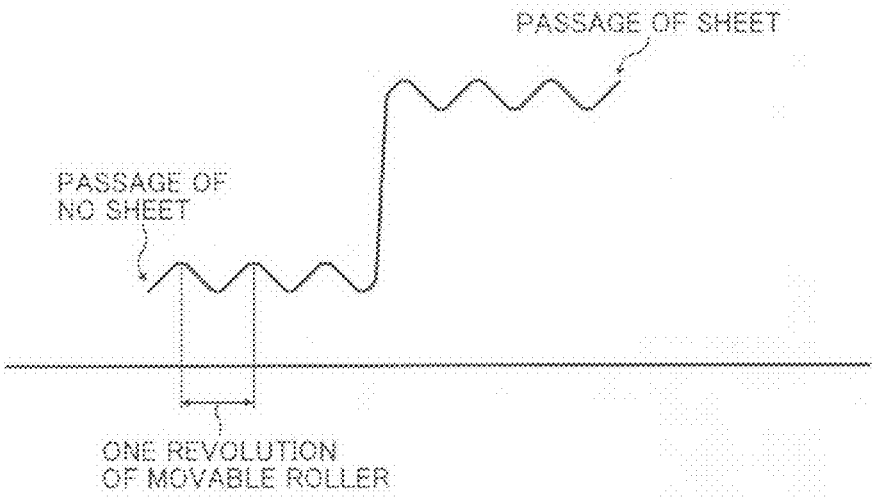
FIG. 26 is a graph illustrating output from a displacement sensor.

The thickness of the sheet P is determined from a difference between the signal output from the displacement sensor 70 when a sheet passes through the nip between the pair of registration rollers 33 and 34, and the signal output from the sensor when no sheet passes through the nip. However, since the registration roller 34 is typically eccentric, the signal output from the sensor 70 is typically waved as illustrated in FIG. 26, wherein the signal has a cycle corresponding to one revolution of the displacement registration roller 34. Therefore, a method for determining the thickness of the sheet P only from one data output from the sensor unavoidably produces an error due to the eccentricity of the roller.

Figure 27:
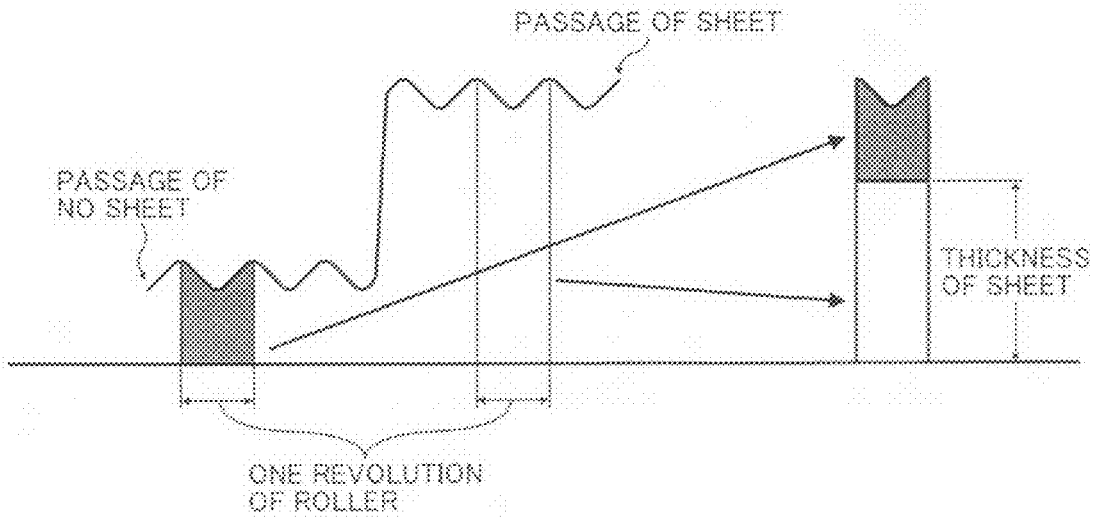
FIG. 27 is a view illustrating a sheet thickness determining method for use in the sheet thickness detector of the present invention.

In a sheet thickness determination method illustrated in FIG. 27 for use in the sheet thickness detector of the present invention, each of the outputs from the sensor in one cycle in the sheet passage state and no-sheet passage state is integrated to determine the difference therebetween, resulting in determination of the thickness of the sheet P.

Figure 28:
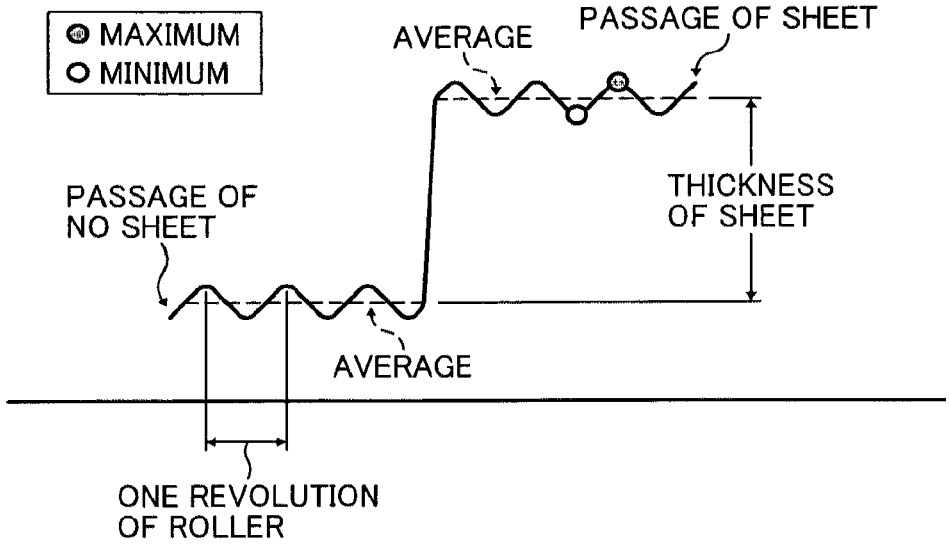
FIG. 28 is a view illustrating another sheet thickness determining method for use in the sheet thickness detector of the present invention.

Alternatively, another sheet thickness determination method illustrated in FIG. 28 can also be used for the sheet thickness detector of the present invention. In the method, the average value of each of the outputs in the sheet passage state and no-sheet passage state in a range longer than one cycle is determined to determine the difference therebetween, resulting in determination of the thickness of the sheet P.

Figure 29:
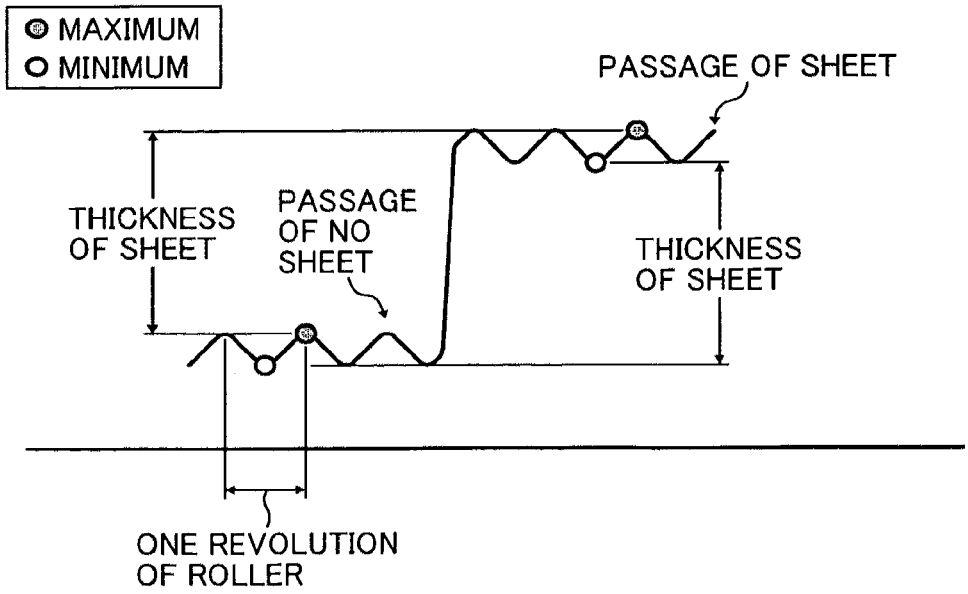
FIG. 29 is a view illustrating yet another sheet thickness determining method for use in the sheet thickness detector of the present invention.

Alternatively, yet another sheet thickness determination method illustrated in FIG. 29 can also be used. In the method, the thickness of the sheet P is determined from the difference between the minimum (or maximum) value of the output in the sheet passage state and the minimum (or maximum) value of the output in the no-sheet passage state. In this regard, it is preferable to determine the thickness from the difference between the minimum values. This is because the maximum value is varied by foreign materials adhered to the sheet and/or the registration roller, but the minimum value is hardly varied even when recessed portions are present on the sheet and/or the registration roller.

Figure 30:
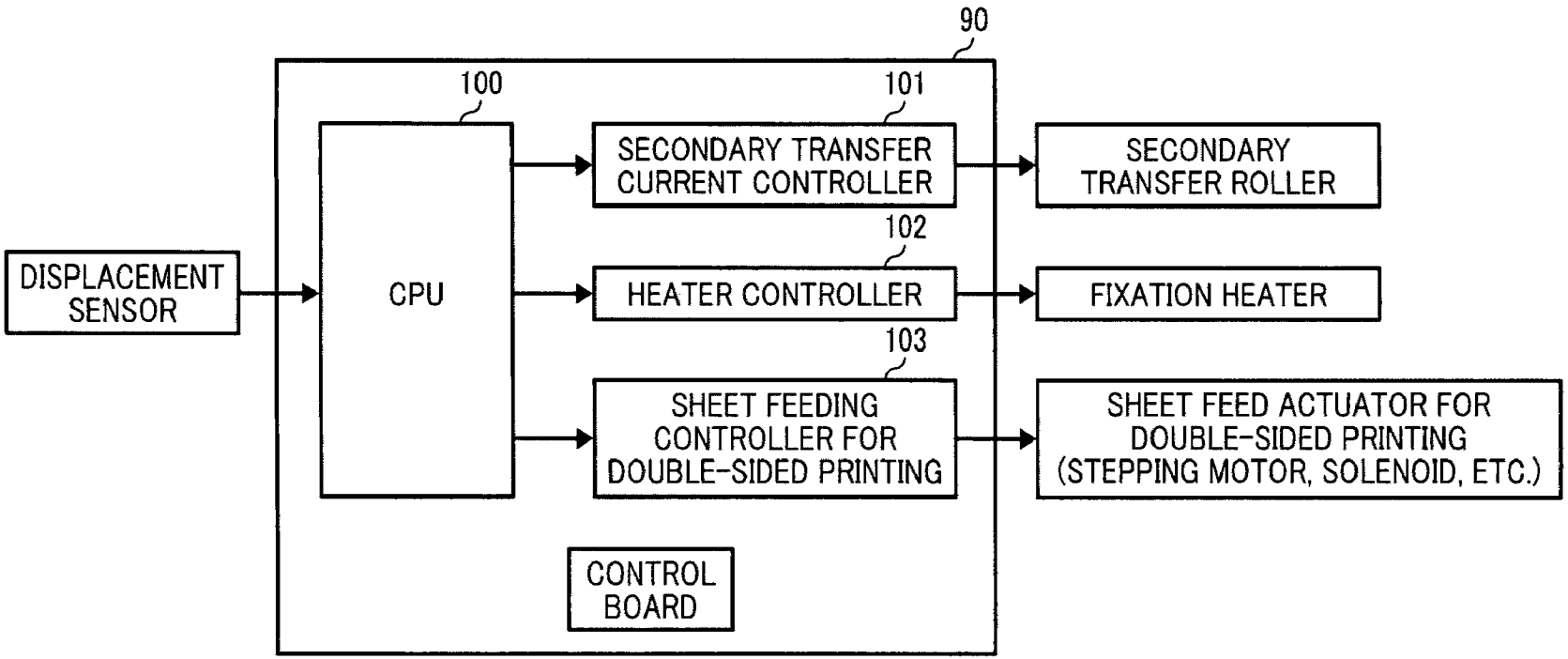
FIG. 30 is a block diagram illustrating a controller for use in the image forming apparatus of the present invention.

FIG. 30 is a block diagram illustrating a controller 90 of the image forming apparatus of the present invention.

The signal output from the displacement sensor 70 in the no-sheet passage state in which the sheet P does not enter the pair of registration rollers 33 and 34 is recorded in a CPU 100 of the controller 90. Next, the signal output from the displacement sensor 70 in the sheet passage state in which the sheet P enters the nip of the registration rollers 33 and 34 is also recorded in the CPU 100, so that the CPU determines the thickness of the sheet on the basis of the difference between the signals.

This example of the image forming apparatus of the present invention classifies the sheet P entering the nip of the pair of registration rollers 33 and 34 into three categories (types), i.e., a paper having a normal thickness, a paper having an intermediate thickness, or a thick paper. In addition, the image forming apparatus determines the image forming conditions, i.e., the secondary transfer bias current applied to the secondary transfer member 9, and the fixing temperature of the fixing device 10, as illustrated in Table 1 below, on the basis of the detection result.

Specifically, as illustrated in FIG. 30, when the type of the sheet P entering the pair of registration rollers 33 and 34 is determined, the CPU 100 orders a secondary transfer bias current controller 101 to control the secondary transfer bias current of the secondary transfer member 9 to the predetermined secondary transfer bias current. In addition, the CPU 100 orders a heater controller 102 to control the fixing temperature of the fixing device 20 (e.g., the temperature of the fixing roller 21) to the predetermined fixing temperature by controlling a fixation heater. By performing such controlling operations, high quality images can be formed on the sheet P even when the type (thickness) of the sheet changes.

Further, as illustrated in FIG. 30, the image forming apparatus controls a sheet feed actuator for duplex printing (such as stepping motors and solenoids) via a sheet feeding controller 103 for duplex printing.

TABLE 1

| | Normal thickness paper | Intermediate thickness paper | Thick paper |
|---|---|---|---|
| Secondary transfer bias current (μA) | 14 | 14 | 8 |
| Fixing temperature (° C.) | 175 | 180 | 200 |

The above-mentioned sheet thickness detector uses the registration rollers 33 and 34 as the fixed member and displacement roller, respectively. However, the sheet thickness detector of the present invention is not limited thereto. The only limitation in this regard is that, since the secondary transfer bias current is changed depending on the results of the sheet thickness determining operation, the sheet thickness detector has to be set upstream from the secondary transfer member 9 in the sheet feeding direction.

Figure 31:
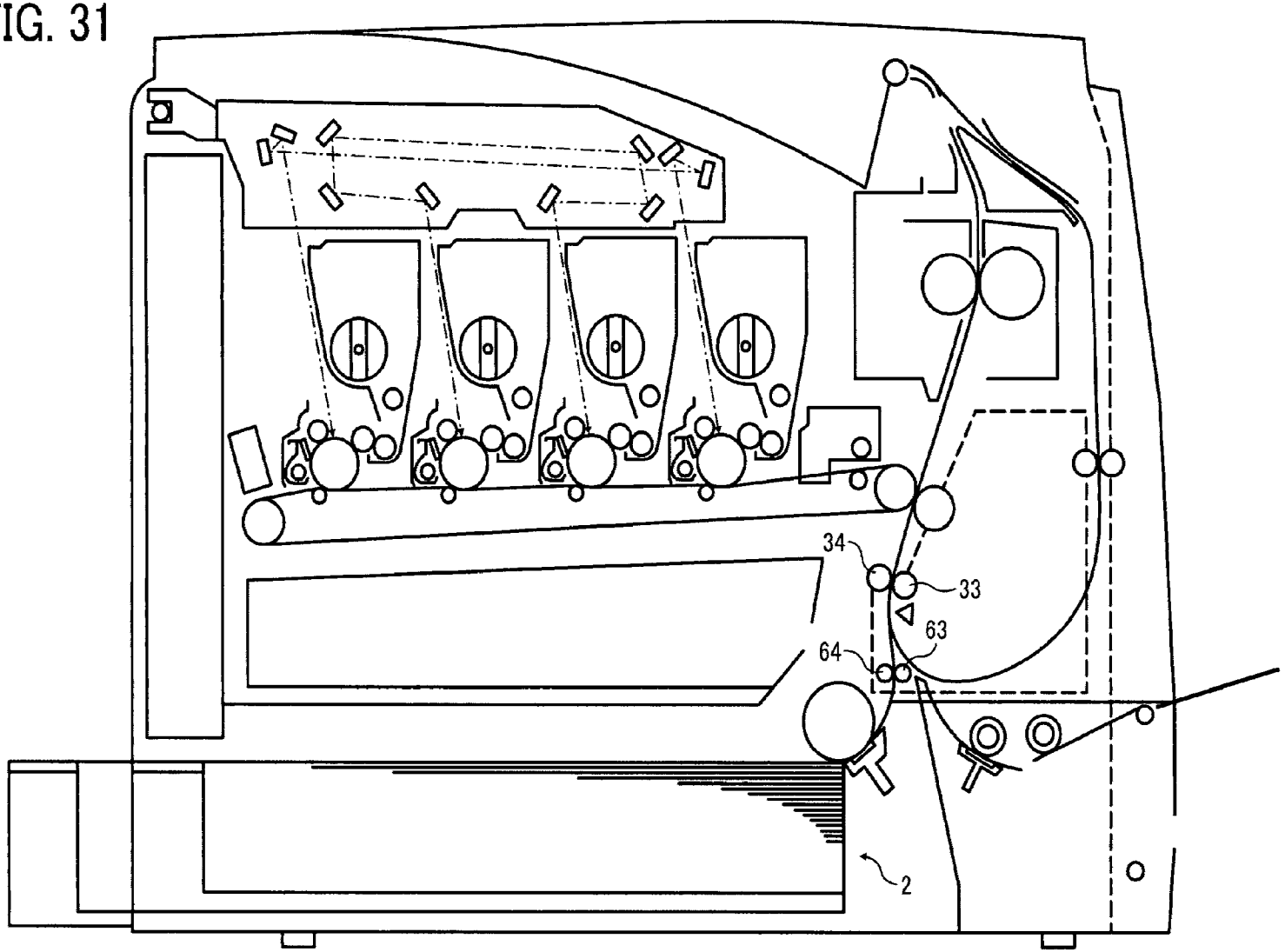
FIG. 31 is a schematic view illustrating yet another example of the image forming apparatus of the present invention.

FIG. 31 illustrates another example of the image forming apparatus of the present invention. In the image forming apparatus, the sheet thickness detector uses a pair of feed rollers 63 and 64, which are arranged between the sheet feeding device 2 and the pair of registration rollers 33 and 34, as the fixed member and displacement roller, respectively. In this regard, the feed roller 63 may be a plate or the like instead of a roller.

Hereinbefore, the present invention is described with reference to sheet thickness detectors using a contact type of sensor. However, the present invention is not limited thereto, and can be applied to a sheet thickness detector using a non-contact type of sensor.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Applications Nos. 2009-209193 and 2010-124182, filed on Sep. 10, 2009, and May 31, 2010, respectively, the entire contents of which are herein incorporated by reference.

What is claimed is:

1. A sheet thickness detector for determining thickness of a sheet, comprising:

a fixed member;

a displacement roller disposed opposite the fixed member and movable in such a linear direction as to be contacted with or separated from the fixed member when the sheet passes between the fixed member and the displacement roller;

bearings rotatably supporting a shaft of the displacement roller;

a displacement member movable in the linear direction in conjunction with the displacement roller, the displacement member being integrated with at least one of the bearings; and a displacement sensor configured to detect displacement of the displacement member to determine the thickness of the sheet passing through a nip.

2. The sheet thickness detector according to claim 1, wherein the fixed member is a roller.

3. The sheet thickness detector according to claim 1, further comprising:

a restriction member configured to restrict movement of the displacement member in any direction other than the linear direction.

4. The sheet thickness detector according to claim 3, wherein the displacement sensor is attached to the restriction member.

5. The sheet thickness detector according to claim 1, wherein the displacement member is engaged with the bearings.

6. The sheet thickness detector according to claim 1, wherein the displacement sensor is contacted with a surface of the displacement member.

7. The sheet thickness detector according to claim 6, wherein the surface of the displacement member contacting the displacement sensor has a larger curvature than a circumferential surface of the displacement roller.

8. The sheet thickness detector according to claim 6, wherein the surface of the displacement member contacting the displacement sensor is a flat surface perpendicular to the linear direction in which the displacement roller moves.

9. The sheet thickness detector according to claim 1, further comprising:

a cleaner provided on a surface of the displacement member opposed to the displacement roller to clean a circumferential surface of the displacement roller.

10. An image forming apparatus comprising:

an image forming device configured to form a visible image on a sheet;

a sheet feeding device configured to feed the sheet to the image forming device; and the sheet thickness detector according to claim 1, configured to determine thickness of the sheet before the visible image is formed on the sheet in the image forming device.

11. The image forming apparatus according to claim 10, wherein the sheet feeding device includes a pair of registration rollers configured to stop the sheet once and then feed the sheet to the image forming device, and wherein one of the pair of registration rollers serves as the displacement roller, and the other of the pair of registration rollers serves as the fixed member.

12. The image forming apparatus according to claim 10, wherein the sheet feeding device includes a pair of feed rollers configured to feed the sheet to the image forming device, and wherein one of the pair of feed rollers serves as the displacement roller, and the other of the pair of feed rollers serves as the fixed member.

13. The image forming apparatus according to claim 10, further comprising a controller configured to control operations of the image forming apparatus, wherein the image forming device includes a transfer device configured to transfer a toner image on the sheet while applying a transfer bias to the sheet, and wherein the controller controls current of the transfer bias based on the thickness of the sheet determined by the sheet thickness detector.

14. The image forming apparatus according to claim 10, further comprising a controller configured to control operations of the image forming apparatus, wherein the image forming device includes a fixing device configured to heat the visible image at a fixing temperature, and wherein the controller controls the fixing temperature based on the thickness of the sheet determined by the sheet thickness detector.

15. The image forming apparatus according to claim 10, further comprising a controller configured to control operations of the image forming apparatus, wherein the image forming device includes a reverse passage configured to reverse the sheet to form visible images on both surfaces of the sheet, and wherein the controller determines whether or not the sheet can pass through the reverse passage based on the thickness of the sheet determined by the sheet thickness detector, and when the controller determines that the sheet cannot pass through the reverse passage, the controller does not feed the sheet to the reverse passage.

* * * * *